US007347070B1

(12) United States Patent
Spector

(10) Patent No.: US 7,347,070 B1
(45) Date of Patent: Mar. 25, 2008

(54) LOCKING ACCESS BOX COVER

(76) Inventor: David Spector, 1043 W. 11th St., Mesa, AZ (US) 85201

( * ) Notice: Subject to any disclaimer, the term of this patent is extended or adjusted under 35 U.S.C. 154(b) by 0 days.

(21) Appl. No.: 11/560,214

(22) Filed: Nov. 15, 2006

(51) Int. Cl.
*B65D 55/14* (2006.01)

(52) U.S. Cl. ..... 70/169; 70/168; 404/25

(58) Field of Classification Search ..... 70/168, 70/169; 220/325; 404/25
See application file for complete search history.

(56) References Cited

U.S. PATENT DOCUMENTS

| | | | | | |
|---|---|---|---|---|---|
| 822,562 | A * | 6/1906 | Tucker | 292/37 |
| 845,182 | A * | 2/1907 | Letts | 70/168 |
| 1,204,464 | A * | 11/1916 | Lofton | 137/371 |
| 1,458,391 | A * | 6/1923 | Burton | 137/371 |
| 1,616,298 | A * | 2/1927 | Arnett | 70/168 |
| 1,788,118 | A * | 1/1931 | Meyer | 70/168 |
| 1,879,359 | A * | 9/1932 | Linfert et al. | 70/169 |
| 1,986,203 | A * | 1/1935 | Ivandick | 70/168 |
| 2,022,267 | A | 11/1935 | Zeek | |
| 2,217,775 | A * | 10/1940 | Smith | 70/168 |
| 2,363,567 | A | 11/1944 | Blakeman | |
| 4,723,866 | A * | 2/1988 | McCauley | 404/25 |
| 4,902,165 | A | 2/1990 | Embree | |
| 4,964,755 | A * | 10/1990 | Lewis et al. | 404/25 |
| 5,275,501 | A | 1/1994 | Amorese et al. | |
| 6,732,555 | B1 | 5/2004 | Nielsen | |
| 6,739,796 | B1 * | 5/2004 | Del Nero et al. | 404/25 |
| 6,763,967 | B2 | 7/2004 | Calder | |
| 2004/0244444 | A1 * | 12/2004 | Wadsworth | 70/168 |

* cited by examiner

*Primary Examiner*—Suzanne Dino Barrett
(74) *Attorney, Agent, or Firm*—Schmeiser, Olsen & Watts LLP

(57) ABSTRACT

A locking access box cover includes an access box cover having a key aperture and a locking mechanism coupled to the access box cover. The locking mechanism includes a base plate, a guide plate coupled to the base plate and a rotating mechanism operatively coupled between the base plate and the guide plate. The rotating mechanism may be rotatable between a locked and an unlocked position and include a key hole corresponding to the key aperture of the cover. The locking mechanism may also include a lock rod operatively coupled to the rotating mechanism. The locking mechanism includes a lock bracket having an aperture for receiving the lock rod therethrough, wherein the rotation of the rotating mechanism produces translational movement of the at least one lock rod with respect to the base plate. The locking access box cover may also comprise a cap removably securable over the key aperture.

13 Claims, 4 Drawing Sheets

LOCKING ACCESS BOX COVER

BACKGROUND OF THE INVENTION

1. Technical Field

This invention relates generally to an access box cover, and more particularly to an access box cover with a lock that is integral with the cover or is retro fit onto existing access box covers.

2. State of the Art

In-ground enclosures and access boxes are often used to provide access to valves that control a water main, such as city water mains and private water mains which are buried under or near streets. The valves within the access box may be used to shut-off the water main or isolate lateral lines that branch off of the main for such reasons as working on the water system or the structure fed by the main or localizing a leak within the water main and branching lines. Often times, this is accomplished by use of an access pipe that extends into the access box, wherein the access pipe provides for the use of a tool to open and close the valve of the water main.

In-ground enclosures and access boxes are also used to provide access to meters that track the water usage by a particular site or user location, such as a home or an office. The meters are frequently accessed by employees of utility companies, so as to prepare an accurate accounting of the water usage of the particular site.

Conventional access boxes have covers that are used to prevent or limit debris from entering the access box, but also serve to protect the valves and meters from damage and to limit access to the valves or meters. Conventional covers are placed over the in-ground enclosure box or access box and commonly do not have a lock for retaining the cover in place over the in-ground enclosure box or access box. They simply rest on a lip within the in-ground enclosure box or access box.

Some other access box covers have locks, but suffer from other limitations, such as, but not limited to, being pried open and/or broken. Conventional access box covers with locks are also lacking in areas such as limiting access to the locking mechanism and functionality of the lock. Because of the limitations of the conventional access box covers with locks, unauthorized individuals may access and often damage the valves. This damage most often results in water loss and/or damage that further causes unplanned financial burdens and wasted resources. Accordingly, there is a need in the field of access box covers for an improved locking access box cover to minimize unauthorized access to the access box to further prevent water loss, damage, lost time and effort.

DISCLOSURE OF THE INVENTION

The present invention relates to a locking access box cover for selectively restricting access to the access box. The locking access box cover includes a locking mechanism that engages a lip of the access box and utilizes a key to actuate the lock. The lock may be integral with the access box cover and may alternatively be retrofitted onto existing access box covers.

An aspect of the present invention includes a locking access box cover comprising: an access box cover having a key aperture and a locking mechanism coupled to the access box cover. The locking mechanism may comprise a base plate, a guide plate coupled to the base plate and a rotating mechanism operatively coupled between the base plate and the guide plate. The rotating mechanism may be rotatable between a locked and an unlocked position, wherein the rotating mechanism includes a key hole corresponding to the key aperture of the cover. The locking mechanism may also include at least one lock rod having a first end and an opposing second end, the first end operatively coupled to the rotating mechanism. The locking mechanism may include at least one lock bracket having an aperture for receiving the second end of the lock rod therethrough, wherein the rotation of the rotating mechanism produces translational movement of the at least one lock rod with respect to the base plate. The locking access box cover may also comprise a cap removably securable over the key aperture. Particular embodiment may include a cap that is one of a threaded cap or a compression sealed cap.

Another aspect of the present invention includes a locking access box cover comprising an access box cover having a key aperture and a locking mechanism coupled to the access box cover. The locking mechanism may include a base plate, a guide plate coupled to the base plate and a rotating mechanism operatively coupled between the base plate and the guide plate. The rotating mechanism may rotate between a locked and an unlocked position, wherein the rotating mechanism includes a key hole corresponding to the key aperture of the cover. The locking mechanism may also include at least one lock rod having a first end and an opposing second end, the first end operatively coupled to the rotating mechanism. The locking mechanism may further include at least one lock bracket having an aperture for receiving the second end of the lock rod therethrough, wherein the rotation of the rotating mechanism produces translational movement of the at least one lock rod with respect to the base plate. The guide plate may also include at least one lock guide, the at least one lock guide being an arcuate guide, limiting the range of motion of the rotating mechanism and the distance of travel of the second end of the lock rod.

Yet another aspect of the present invention includes a method of using a locking access box cover, the method comprising removing a cap from a key aperture of a access box cover, inserting a key into a keyhole of a locking mechanism through the key aperture and turning the key to actuate rotation of a rotating mechanism of the locking mechanism from a locked position to an unlocked position, wherein a lock rod is retracted. The method may also comprise opening the access box cover to access the access box.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a locking access box cover for restricting access to the access box by locking the cover. The locking access box cover includes a locking mechanism that may be integral with the access box cover and may alternatively be retrofitted onto existing access box covers.

As is used herein, the term "access box" is intended to mean any type of access box including, but not limited to in-ground enclosure boxes, valve boxes, utility boxes and the like. For the exemplary purposes of this disclosure, the examples set forth herein depict a locking access box cover in use with a valve box. It will be understood that while it is shown that a locking access box cover may be used with a valve box, this is in no way a limitation of use.

Figure 1:
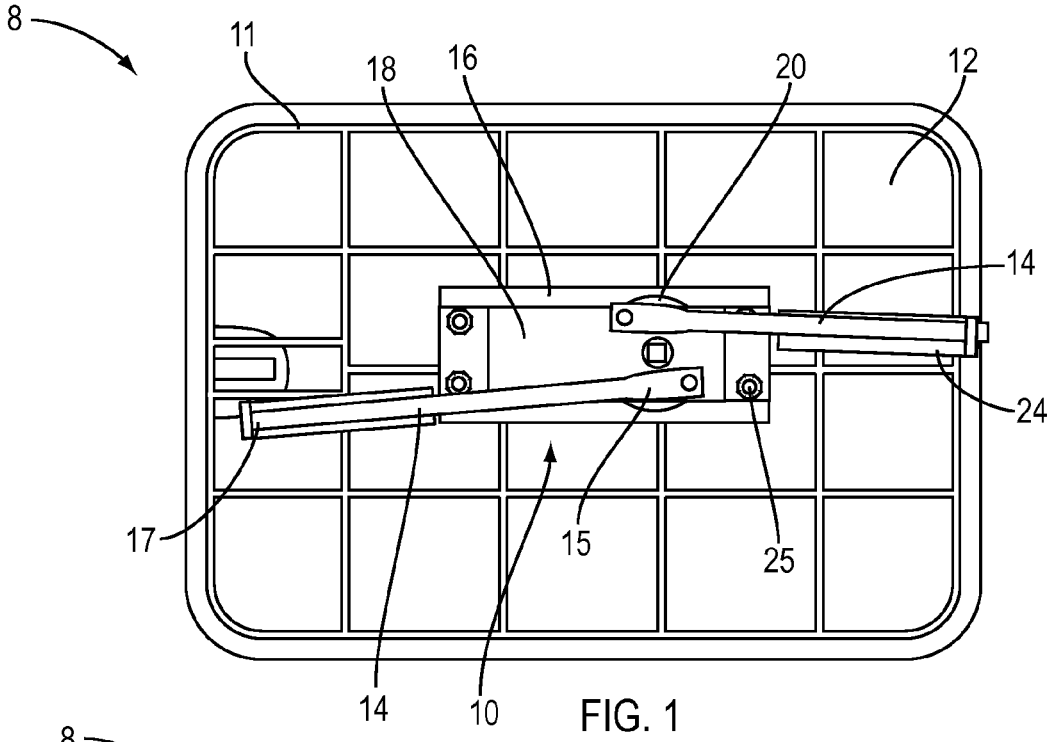
FIG. 1 is a bottom view of a locking access box cover in accordance with the present invention.
Figure 6:
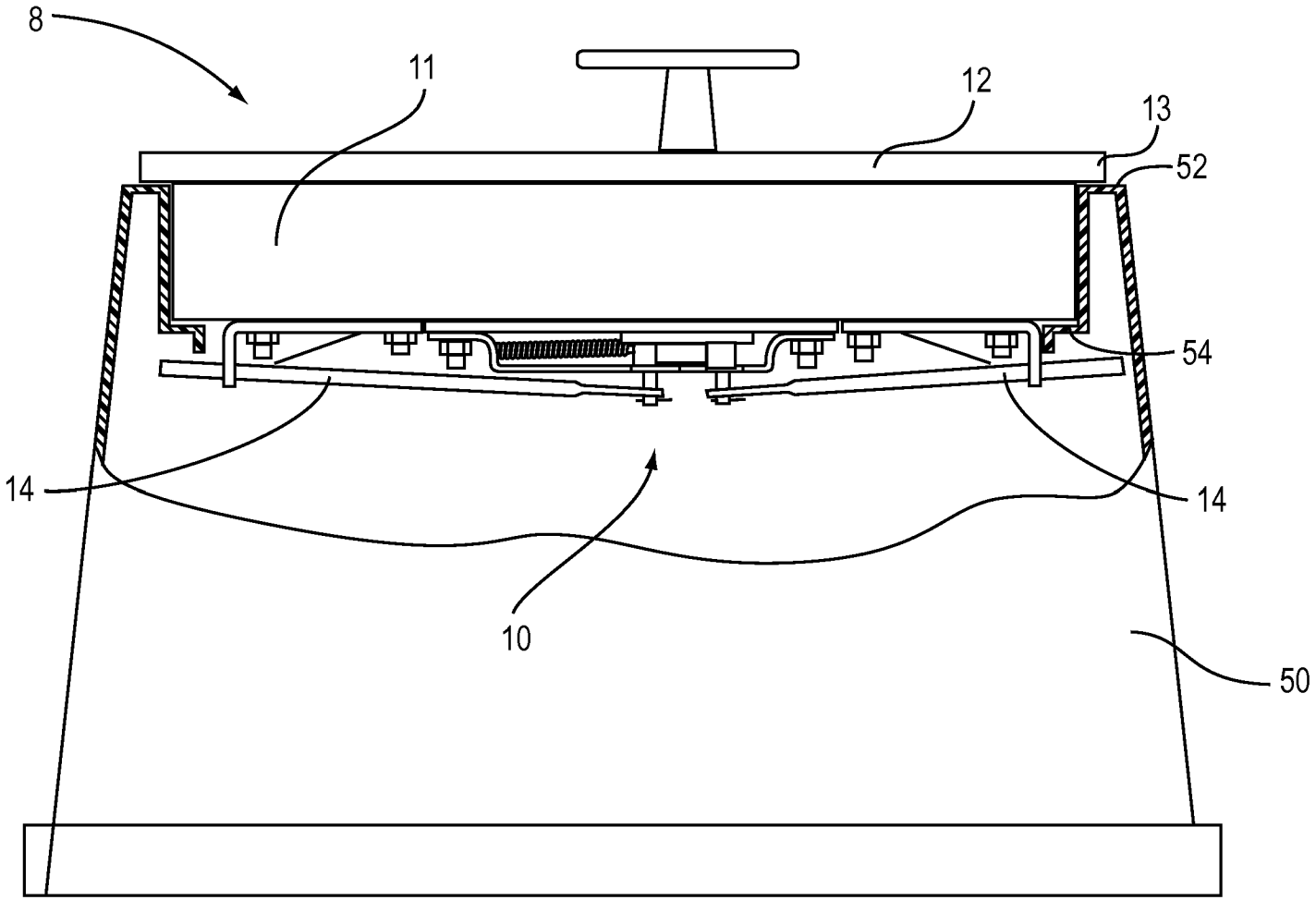
FIG. 6 is a side view of a locking access box cover on a valve box in accordance with the present invention.

With reference to the drawings, FIG. 1 depicts a bottom view of a locking access box cover 8 in accordance with embodiments of the present invention. The locking access box cover 8 may comprise a locking mechanism 10 coupled to a cover 12. The cover 12 may include an inner cover portion 11 for inserting within a valve box. The locking mechanism may include at least one lock rod 14, a base plate 16, a guide plate 18, a rotating mechanism 20 a key hole 22 and a lock bracket 24. The locking mechanism 10 may be coupled to a bottom side of the cover 12 to allow the lock to engage an inner ridge 54 of the valve box 50, as shown in FIG. 6.

Figure 5:
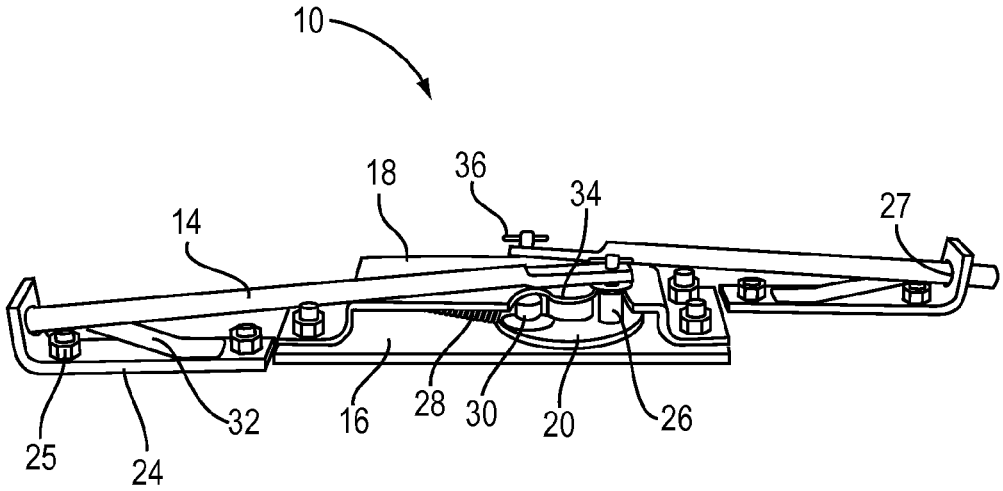
FIG. 5 is a perspective view of a locking mechanism in accordance with the present invention.

Referring to FIG. 1 and with additional reference to FIG. 5, the base plate 16 of the locking mechanism 10 may be coupled to a bottom side of the cover 12. The guide plate 18 may be coupled to the base plate and the rotating mechanism may be operatively coupled between the base plate 16 and the guide plate 18. The rotating mechanism 20 may be rotatable between a locked and an unlocked position. Further, the rotating mechanism 20 may also include a key hole 22 corresponding to a key aperture 23, as shown in FIG. 2B, of the cover 12. The at least one lock rod 14 may be two lock rods 14. The lock rod 14 may have a first end 15 and an opposing second end 17. The first end 15 of the lock rod 14 may be operatively coupled to the rotating mechanism 20 by use of rod coupler 26. The lock rod 14 may be retained on rod coupler 26 by use of lock pin 36. The lock bracket 24 may have an aperture 27 for receiving the second end 17 of the lock rod 14 therethrough. Rotation of the rotating mechanism 20 may produce translational movement of the lock rod 14 with respect to the base plate 16.

The guide plate 18 may include a lock guide 34. The lock guide 34 may limit the range of motion of the rotating mechanism 20 and the distance of travel of the second end 17 of the lock rod 14. The limiting of the range of motion allows for the lock rod 14, when the rotating mechanism 20 is in the locked position, to only extend far enough to engage a ridge portion 54 of the valve box 50, as shown in FIG. 6. Further it limits the range of motion when the rotating mechanism is in the closed position so that the lock rod 14 does not engage the ridge portion 54. In particular embodiments of the present invention, the lock guide 34 may be an arcuate guide. The lock guide 34 may engage the rod coupler 26 and allow the rod coupler 26 to rotate with the rotating mechanism, thereby moving the first end 15 of the lock rod 14 and actuating the translational movement of the lock rod.

A spring 28 may be coupled to the rotating mechanism 20 by use of spring coupler 30. The spring 28 may assist the rotation of the rotating mechanism 20 between the locked and unlocked position. Additionally, the lock bracket 24 may further include a compliant member 32 to ensure that the second end of the lock rod 14 enters the aperture 27 of the lock bracket 24 properly and further ensures the lock rod 14 will not contact coupler 25. Further, the lock bracket 24 may extend, support and strengthen the lock rod 14 from being pried open It will be understood that the base plate 16 and the guide plate 18 may be coupled together and the base plate 16 coupled to the cover 12 by use of couplers 25. Further, the lock bracket 24 may also be coupled to the cover 12 by use of couplers 25. Additionally, the couplers 25 may extend through the cover 12 and a portion of the coupler 25 may engage a top side of the cover 12, as shown in FIG. 2B. It will be understood that the couplers 25 may be any type of coupler, including, but not limited to a nut and bolt, a screw, a clip, a clamp, a rivet, a weld, an adhesive and/or any other type of coupler and combinations thereof. Further, while it is shown that the lock bracket 24 is separate from the base plate 16, it will be understood that in particular embodiments of the present invention, the lock bracket may be integral with the base plate 16.

Figure 2A:
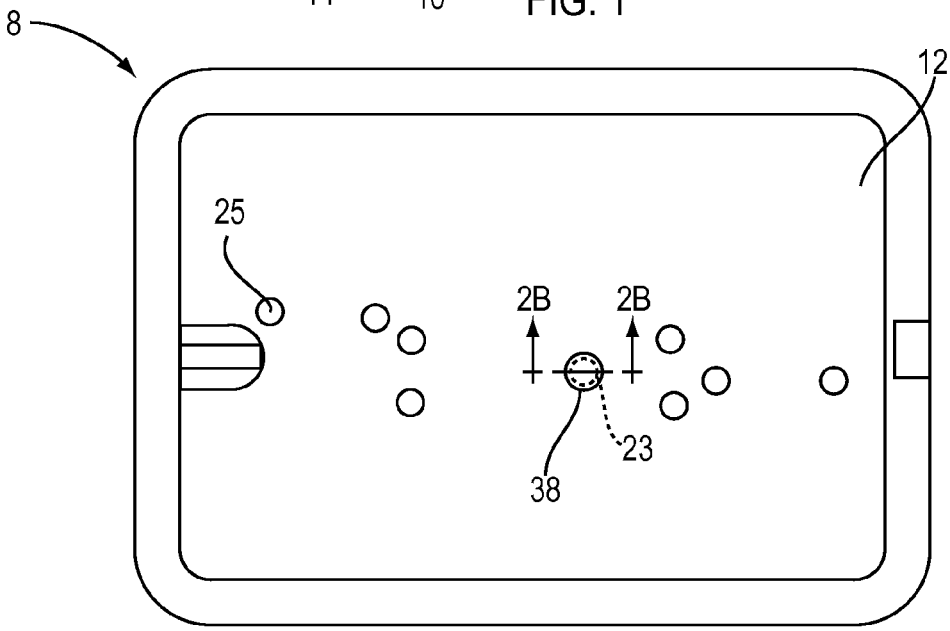
FIG. 2A is top view of a locking access box cover in accordance with the present invention.
Figure 2B:
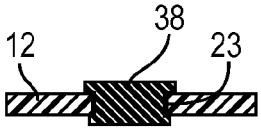
FIG. 2B is a section view taken along line 2B—2B of FIG. 2A of a cap of a locking access box cover in accordance with the present invention.
Figure 3:
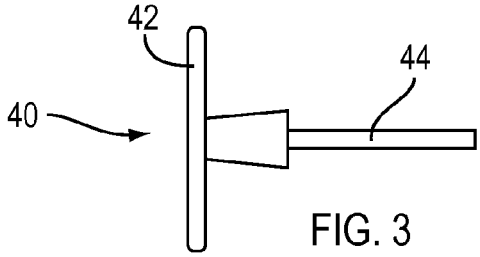
FIG. 3 is a side view of a key in accordance with the present invention.

Referring further to the drawings, FIGS. 2A and 2B depicts a locking access box cover 8 according to particular embodiments of the present invention. The locking access box cover 8 may include cover 12, key aperture 23 and cap 38. The key aperture 23 may correspond to the key hole 22 of the locking mechanism 10. The cap 38 may be removably securable over the key aperture 23. The cap 38 may limit access to the locking mechanism 10 and may further provide protection for the locking mechanism 10. The cap 38 is required to be removed in order to access the key hole 22. With the cap 38 in place, the cap 38 prevents debris and the like from entering the key aperture 23 and interfering with the proper operation of the locking mechanism 10. In particular embodiments of the present invention, the cap 38 may be formed of a flexible and durable material such as, but not limited to rubber. In other particular embodiments, the cap 38 may resemble the couplers 25 such as a bolt head and may not be recognizable as a removable cap 38, thus providing additional prevention of opening the access box cover 8. Additionally, added measures may be incorporated to further limit access to the valve box if so desired, such as but not limited to, providing a lock for removing the cap 38, wherein only those who have means to unlock the cap can gain access to the locking mechanism 10 of the locking access box cover 8 and/or using a cap 38 that is a bolt which fits into the key hole 22, wherein the bolt is rotatably held therein.

Other particular embodiments of the present invention may include a cap 38 that is a locking lug nut. Further other embodiments may include a cap 38 that is a locking cam nut. These particular caps of a locking lug not and a locking cam nut may use a key 40 (shown in FIG. 4) to activate and remove the cap 38. It will be understood that while the key 40 may be used, the present invention is not limited to the key 40, other keys and/or unlocking devices may be utilize to remove and secure the cap 38 in place.

Figure 4:
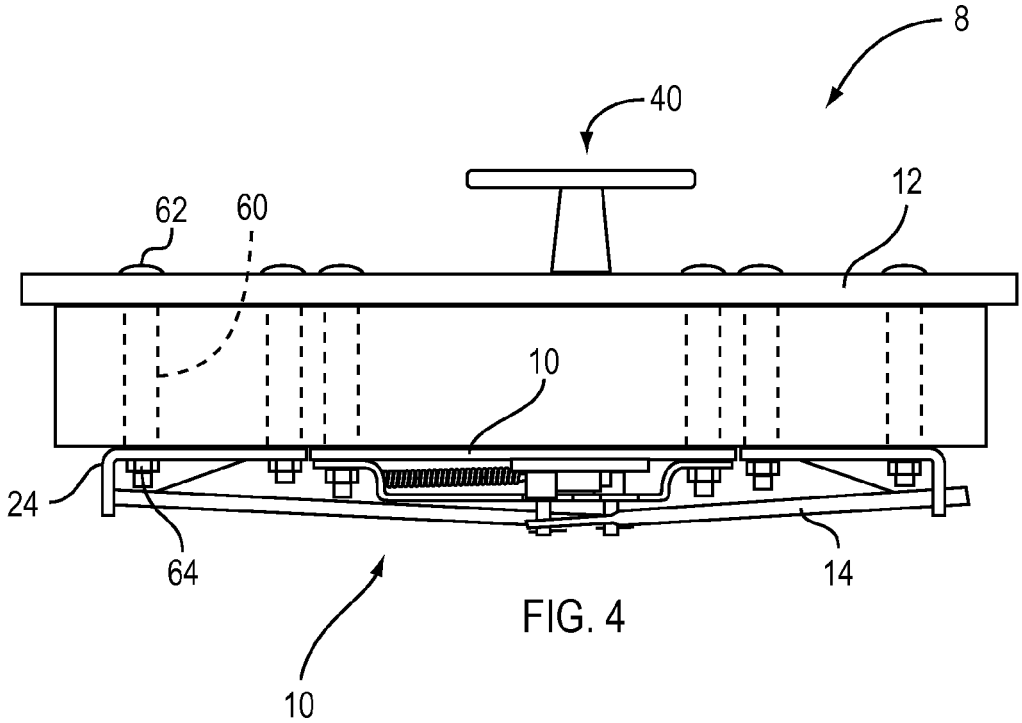
FIG. 4 is side view of a locking access box cover in accordance with the present invention.

Again, with further reference to the drawings, FIG. 4 depicts a key 40 of a locking access box cover 8. The key 40 may comprise a handle 42 and a key shaft 44. The key shaft 44 of the key 40 engages the key hole 22 of the locking mechanism 10. The handle 42 of the key 40 allows a user to turn the key and actuate the locking mechanism 10. The key shaft may have a cross-section size and shape so as to correspond to the size and shape of the key hole 22. Further, the key aperture 23 may also be of a size and shape to allow the key shaft to extend therethrough without interferences of the cover 12. The shape of the key hole 22 and the cross-sectional shape of the key shaft 44 may include, but is not limited to, a square, a rectangle, a triangle, a pentagon, a hexagon, an octagon and any other rectilinear shape. Further, the key shaft may have varying lengths to correspond to different cover 12 depths and distances from the top of the cover 12 to the key hole 22. Additionally, the handle 42 may be of any size and shape so long as it allows a user to turn the key and provide sufficient torque to actuate the locking mechanism 10.

Referring again to the drawings, FIG. 4 is a side view of a locking access box cover 8 according to particular embodiments of the present invention. The locking mechanism 10 may be coupled to a bottom side of the cover 2 of the locking access box cover 8. According to particular embodiments of the present invention, the locking mechanism may be integral with the cover 12 to form the locking access box cover 8. Alternatively, particular embodiments of the present invention allow for the locking mechanism 10 to be retro fitted onto existing access box covers. In these particular embodiments, spacers 60, shown in dashed lines, may be utilized to ensure that the locking mechanism 10 is coupled at a location to allow the lock rods 14 to extend under a ridge portion of a valve box. The spacers 60 allow for a coupler, such as a bolt 62 with a nut 64, to extend therethrough and couple the locking mechanism 10 to the cover 12. In particular embodiments of the present invention, the spacers 60 may be hollow circular cylinders, however, they are not limited to a particular shaped cylinder, and may include without limitation square cylinders, triangular cylinders and the like. The spacers 60 may be of equal lengths wherein the lengths of the spacers 60 allow the base plate 16 and the lock brackets 24 of the locking mechanism 10 to be coupled to the cover 12 such that top portions of the base plate 16 and the bracket 24 are substantially within the same plane. The spacers 60 further are of a length to correspond to the length of the key shaft 44 of the key 40, thereby allowing the key shaft 44 to extend into the key hole 22 of the locking mechanism 10.

With further reference to the drawings, FIG. 6 depicts a side view of a locking access box cover 8 covering a valve box 50. The valve box 50 may any type of typical valve box, wherein the valve box 50 may include a top ridge 52 and an inner ridge 54. The locking access box cover 8 may include a cover 12 and a locking mechanism 10. The cover may include an inner cover portion 11 and a lip portion 13. The inner cover portion 11 may be configured to rest on the inner ridge 54 of the valve box 50. The lip portion 13 may be configured to rest on the top ridge 52 of the valve box 50. The locking mechanism 10 may be moved between a locked position and an unlocked position. In the locked position, the lock rods 14 extend under the inner ridge 54 and engage the inner ridge 54, thereby preventing the lifting of the locking access box cover 8. When moved into the unlocked position, the lock rods are retracted to disengage the lock rods 14 from the inner ridge 54, thereby allowing lifting of the locking access box cover 8 from the valve box 50. A user may then access the valve box 50. In particular embodiments, when the locking mechanism is in the unlocked position the lock rod may not retract fully and may further partially engage the inner ridge 54. In these particular embodiments, removal of the locking access box cover requires the lifting of the side opposite the lock rod 14 that remains partially engaged with the inner ridge 54 to lift the entire locking access box cover 8 from the valve box 50.

Figure 7:
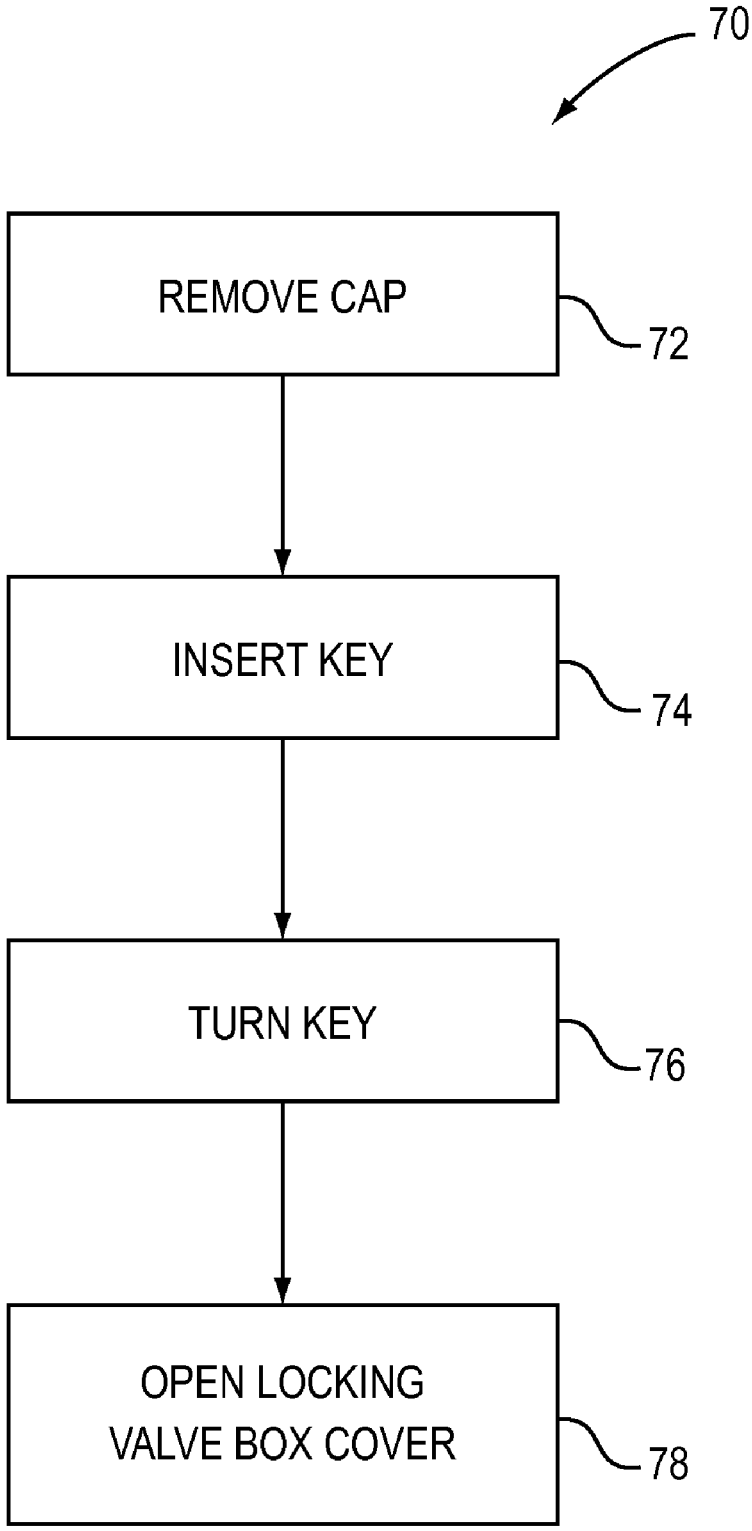
FIG. 7 is a flow chart of a method of using a locking access box cover in accordance with the present invention.

FIG. 7 of the drawings depicts a flow chart of a method 70 of using a locking access box cover according to embodiment of the present invention. The method 70 may comprise the steps of removing a cap from a key aperture of an access box cover (Step 72); inserting a key into a keyhole of a locking mechanism through the key aperture (Step 74); turning the key to actuate rotation of a rotating mechanism of the locking mechanism from a locked position to an unlocked position, wherein the lock rod is retracted (Step 76); and opening the access box cover to access the access box (Step 78). In particular embodiments of the present invention, Step 76 may further include turning the key a predetermined range of motion governed by a lock guide of the locking mechanism.

The method 70 may further include the steps of closing the access box cover; inserting a key into a keyhole of a locking mechanism through the key aperture; turning the key to actuate rotation of a rotating mechanism of the locking mechanism from a locked position to an unlocked position, wherein a lock rod is extended; and inserting the cap in the key aperture of the access box cover.

The components defining any embodiment of a locking access box cover in accordance with the present invention may be formed of any of many different types of materials or combinations thereof that can readily be formed into shaped objects provided that the components selected are consistent with the intended operation of a locking access box cover. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any embodiment of a locking access box cover in accordance with the present invention may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A locking access box cover comprising:

an access box cover having a key aperture;

a locking mechanism coupled to the access box cover, the locking mechanism comprising:

a base plate;

a guide plate coupled to the base plate;

a rotating mechanism operatively coupled between the base plate and the guide plate, the rotating mechanism is rotatable between a locked and an unlocked position, wherein the rotating mechanism includes a key hole corresponding to the key aperture of the cover;

at least one lock rod having a first end and an opposing second end, the first end operatively coupled to the rotating mechanism; and at least one lock bracket having an aperture for receiving the second end of the lock rod therethrough, wherein the rotation of the rotating mechanism produces translational movement of the at least one lock rod with respect to the base plate; and a cap removably securable over the key aperture.

2. The locking access box cover of claim 1, wherein the guide plate includes at least one lock guide, the at least one lock guide limiting the range of motion of the rotating mechanism and the distance of travel of the second end of the lock rod.

3. The locking access box cover of claim 1, further comprising a key for actuating the locking mechanism by use of the key hole, wherein the key accesses the keyhole through the key aperture.

4. The locking access box cover of claim 1, further comprising a spring coupled to the rotating mechanism, wherein the spring assists the rotation of the rotating mechanism between the locked and unlocked position.

5. The locking access box cover of claim 1, wherein the rotating mechanism in the locked position extends the second end of the at least one lock rod under a lip portion of a access box, and the rotating mechanism in the unlocked position retracts the second end of the lock rod away from the lip portion of the access box.

6. The locking access box cover of claim 1, wherein the cap resembles a bolt head, the bolt head resembling other bolt heads coupled to the access box cover.

7. The locking access box cover of claim 1, wherein the cap is a bolt rotatably held within the key hole of the rotating mechanism.

8. A locking access box cover comprising:

an access box cover having a key aperture;

a locking mechanism coupled to the access box cover, the locking mechanism including:

a base plate;

a guide plate coupled to the base plate;

a rotating mechanism operatively coupled between the base plate and the guide plate, the rotating mechanism is rotatable between a locked and an unlocked position, wherein the rotating mechanism includes a key hole corresponding to the key aperture of the cover;

at least one lock rod having a first end and an opposing second end, the first end operatively coupled to the rotating mechanism;

at least one lock bracket having an aperture for receiving the second end of the lock rod therethrough, wherein the rotation of the rotating mechanism produces translational movement of the at least one lock rod with respect to the base plate; and a spring coupled to the rotating mechanism, wherein the spring assists the rotation of the rotating mechanism between the locked and unlocked position.

9. The locking access box cover of claim 8, further comprising a key for actuating the locking mechanism by use of the key hole, wherein the key accesses the keyhole through the key aperture.

10. The locking access box cover of claim 8, wherein the rotating mechanism in the locked position extends the second end of the at least one lock rod under a lip portion of a access box, and the rotating mechanism in the unlocked position retracts the second end of the lock rod away from the lip portion of the access box.

11. The locking access box cover of claim 8, further comprising a cap removably securable over the key aperture.

12. The locking access box cover of claim 11, wherein the cap resembles a bolt head, the bolt head resembling other bolt heads coupled to the access box cover.

13. The locking access box cover of claim 11, wherein the cap is a bolt rotatably held within the key hole of the rotating mechanism.

* * * * *